United States Patent [19]

Collins et al.

[11] Patent Number: 4,797,036

[45] Date of Patent: Jan. 10, 1989

[54] MARINE TETHER ANCHORING DEVICE

[75] Inventors: Roger J. Collins, Botley; James R. T. Hodgson, Eastleigh, both of United Kingdom

[73] Assignee: Brown & Root Vickers Technology, London, England

[21] Appl. No.: 137,931

[22] Filed: Dec. 28, 1987

[30] Foreign Application Priority Data

Jan. 12, 1987 [GB] United Kingdom ..... 8700579

[51] Int. Cl.[4] ..... E02D 5/74; B63B 21/50

[52] U.S. Cl. ..... 105/224; 114/294; 166/338; 405/195

[58] Field of Search ..... 405/224, 195, 202, 169, 405/170, 171; 114/293, 294; 166/338, 340, 341, 342

[56] References Cited

U.S. PATENT DOCUMENTS

| | | | |
|---|---|---|---|
| 4,320,993 | 3/1982 | Hunter | 405/224 |
| 4,374,630 | 2/1983 | Frasey | 405/195 X |
| 4,432,670 | 2/1984 | Lawson | 405/224 |
| 4,459,933 | 7/1984 | Burchett | 405/224 X |
| 4,491,439 | 1/1985 | Watkins | 405/195 X |
| 4,585,369 | 4/1986 | Manesse et al. | 403/322 |
| 4,610,570 | 9/1986 | Brockway | 405/224 |
| 4,611,953 | 9/1986 | Owens | 114/294 X |
| 4,647,254 | 3/1987 | Baugh et al. | 405/170 X |
| 4,664,558 | 5/1987 | De Meio et al. | 405/224 |
| 4,708,524 | 11/1987 | Goris | 405/169 |

*Primary Examiner*—Dennis L. Taylor

*Attorney, Agent, or Firm*—Shoemaker and Mattare, Ltd.

[57] ABSTRACT

A marine tether anchoring device comprises a tubular anchor body for eventual attachment at its upper end below a marine tether and a spigot for eventual fixing to the sea bed so as to be upstanding therefrom and for reception in the anchor body to establish the anchor. Latching arms within the anchor body establish a releaseable connection to the spigot. A flexjoint supported within the tubular body transmits tensile load in the anchor body as an inwardly and upwardly directed compressive load through the latching arms to the spigot whilst permitting relative tilting movement between the latching arms and the anchor body consequent upon sway of the tether. The anchoring device can be used with large diameter thin walled tendons and the flexjoint that forms part of the device is located in a compressive part of the load path.

9 Claims, 3 Drawing Sheets

MARINE TETHER ANCHORING DEVICE

FIELD OF THE INVENTION

This invention relates to a marine tether anchoring device.

BACKGROUND TO THE INVENTION

Tension leg marine platforms for use in the offshore oil industry are known and a connector apparatus for connecting such a tension leg to a subsea foundation is described in U.S. Pat. No. 4,320,993 (Conoco). An anchoring device that was used in such a structure in the Hutton field of the North Sea is described in U.S. Pat. No. Re. 32,274 of U.S. Pat. No. 4,459,933.

The tether line described in the Reissue specification and used in practice employed a tether of relatively small diameter and having a relatively thick wall. It has now been realised that it may be desirable to use tendons of larger diameter and with thinner walls but it is difficult to design and make a transition section that will couple such a relatively large tendon to a relatively small flexjoint such as is described in the Reissue specification, particularly where high loads are to be employed.

SUMMARY OF THE INVENTION

It is an object of the invention to provide a marine tether anchoring device that can be used with large diameter thin walled tendons and that avoids the need to locate the flexjoint that forms part of such a device around the tendon load path.

Accordingly, the invention provides a marine tether anchoring device comprising in combination; a tubular anchor body for eventual attachment at its upper end below a marine tether; a spigot for eventual fixing to the sea bed so as to be upstanding therefrom and for reception in the anchor body to establish the anchor; latching means within the anchor body for establishing a releaseable connection to the spigot; and flexjoint means supported within the tubular body for transmitting tensile load in the anchor body as an inwardly and upwardly directed compressive load through the latching means to the spigot whilst permitting relative tilting movement between the latching means and the anchor body consequent upon sway of the tether.

OUTLINE OF PREFERRED FEATURES

The spigot may have a head formed with a downwardly facing conical catch face on which the latching means engages. Advantageously the latching means includes an axially movable support that is generally circular in plan, a plurality of latching arms depending from the support at angularly spaced intervals and having obliquely inturned downwardly facing tips of latching engagement on the catch face of the spigot at a lower position of the support, means for moving the support to an upper position, and means operable on movement of the support to the upper position to radially expand the tips of the latching arms away from latching engagement with the spigot. The latching means may include a body connected to the flexjoint means to maintain its axial position relative to the anchor body as the support moves, said body having first cam means that cooperates with the tips of the latching arms as the support moves towards its lower position to urge said tips radially inwards and second means cooperating with formations on inner faces of the latching arms as the support moves towards its upper position to urge said tips radially outwards.

For effective reaction of downward loads during establishment of the latch connection, the latching means comprises an axially fixed body as aforesaid supported on the flexjoint means and movable members supported on the fixed body for establishing the releaseable connection to the spigot, and the anchoring device includes means for reacting a downward load from the anchor body via a load path that includes only the fixed body of said latching means. The fixed body may be generally bell shaped with a head of the spigot passing to the fixed body and supporting the fixed body at a top part of its undersurface during said downward load and with a bottom rim of said fixed body supported on said flexjoint means, frame means upstanding from said rim cooperating with an inturned part spherical downwardly facing surface of the anchor body to receive downward loads from said body. The upper part of the fixed body may be connected to the rim of the body via spaced fingers and the frame means has upstanding fingers aligned with the fingers of the fixed body, through which upstanding fingers the downward load is received.

In such an arrangement the fingers and the latching arms may oocur in alternate positions about the axis of the anchor body.

BRIEF DESCRIPTION OF DRAWINGS

An embodiment of the invention will now be described by way of example only with reference to the accompanying drawings, in which.

DETAILED DESCRIPTION OF PREFERRED EMBODIMENT

Figure 1:
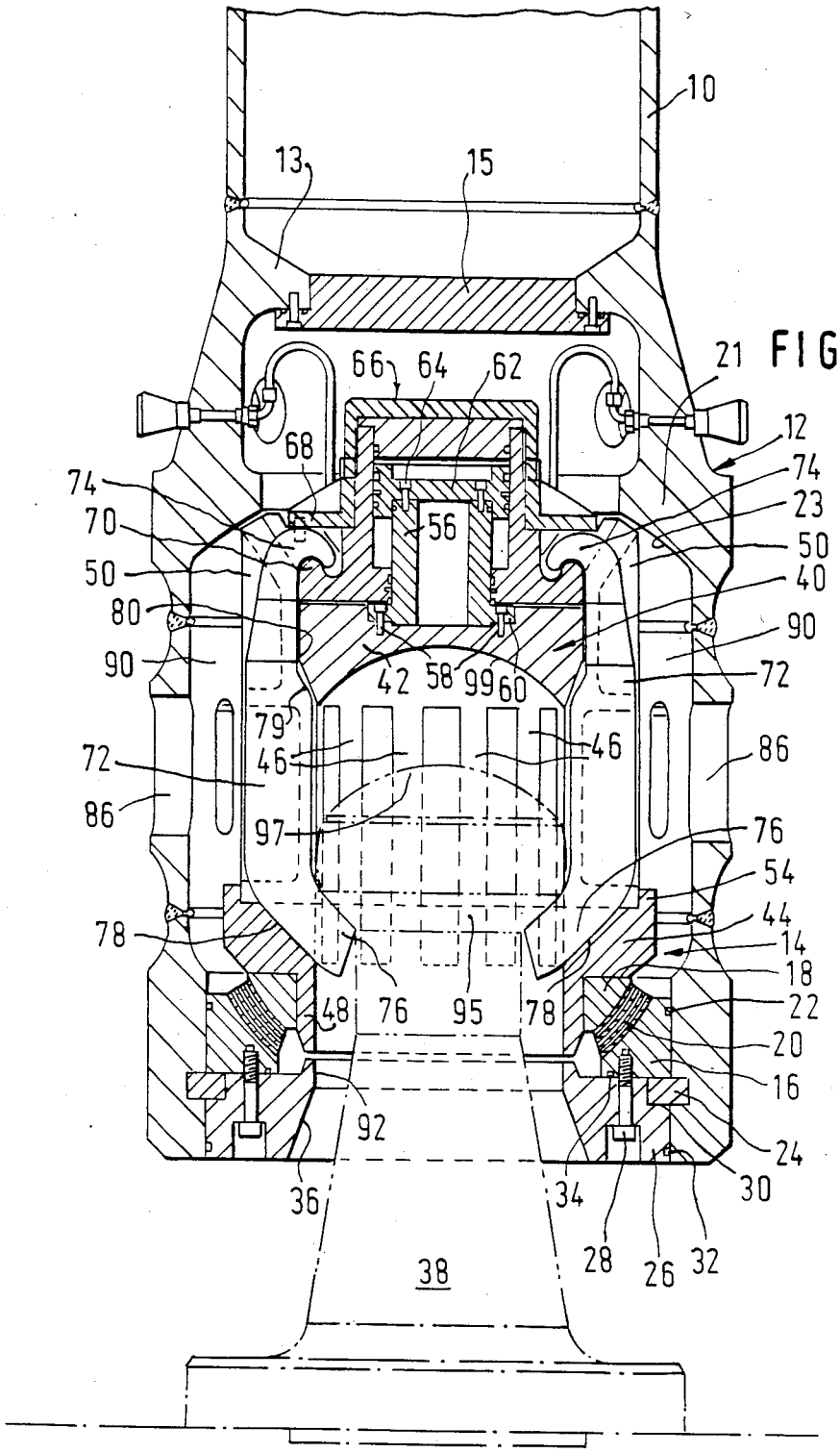
FIGS. 1 and 2 are sectional views of a marine tether anchoring device in latched and release states respectively.

In the drawings, a tubular tendon 10 of a marine tether depends from a marine platform, is of diameter about 1300 cms and weight about 12,500 kg/m. Its lower end is welded or otherwise attached to a tubular anchor body 12 of outside diameter about 1750 cms, slightly larger than that of tendon 10 and which is either formed in one piece or formed in three generally annular sections that are welded together as shown. The upper part of the body 12 is internally flanged at 13 and a bulkhead 15 is bolted to the underside of the flange 13 to exclude sea water from the bore of tendon 10. Alternatively the bulkhead 15 may be attached to the underside of flange 13 by welding. A flexjoint assembly 14 fits within the lower part of the body 12 and comprises a lower rigid annulus 16 and an upper rigid annulus 18 of smaller diameter and inwardly offset from the annulus 16, the annuli 16, 18 being interconnected by a flexible rubber and steel portion 20. The annuli 16, 18 are of generally triangular section and face oppositely as shown. The annulus 16 is a close fit in a cylindrical lower portion of the body 12 to which it is sealed by means of an annular seal 22. The annulus 16 rests on a segmented ring 24 that fits into a recess in the inner surface of the housing 12. A retaining ring 26 is attached, e.g. by means of bolts 28, to the underside of the annulus 16 and has a stepped top outside edge 30 to allow it to fit into the ring 24 which is captive between annulus 16 and ring 26. The ring 26 is also a close fit in the lower portion of the body 12 and is sealed thereto by means of an annular seal 32. A further annular seal 34 fits between the annulus 16 and the ring 26, the seals 22, 32 and 34 serving to exclude sea water from the segmented ring 24. The inner surface of the ring 26 is tapered at 36 to provide an entry cone that guides a sea bed attached central spigot 38 into the anchor body 12 as the assembly is lowered to its intended final position.

Figure 2:
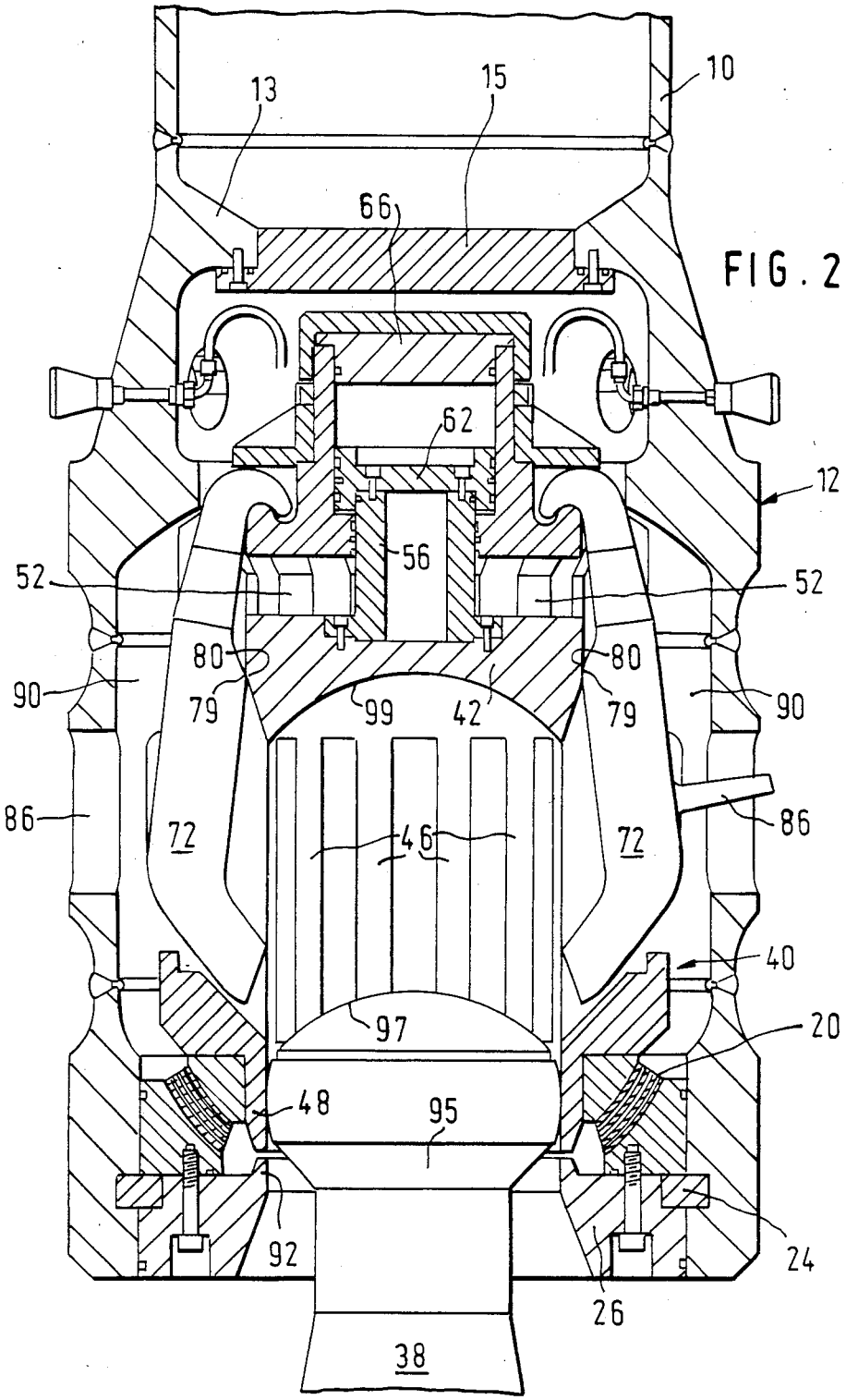
Figure 3:
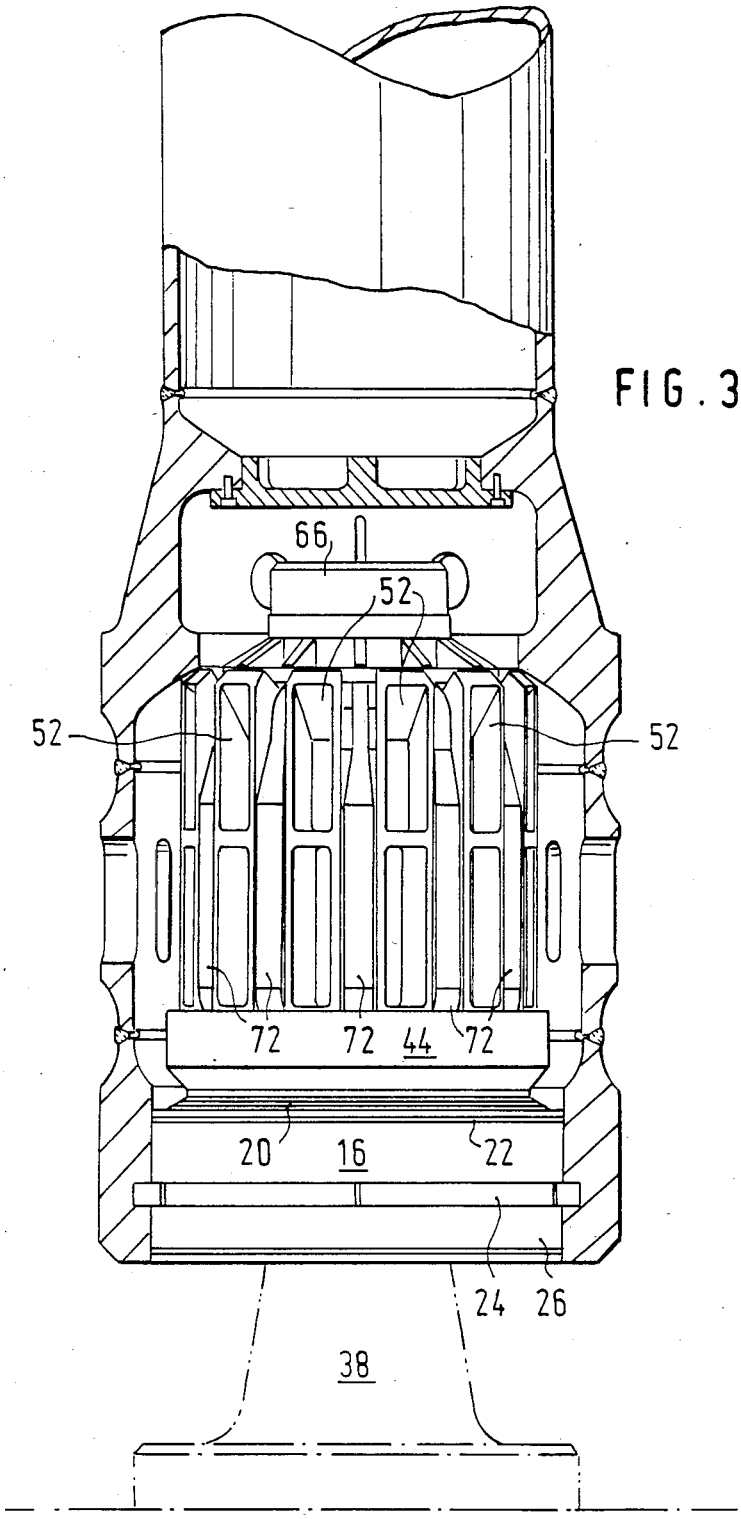
FIG. 3 is a partly sectioned view of the device in the holding state.

A generally bell-shaped member 40 has a solid upper part 42 connected to an annular lower part 44 by a plurality of angularly spaced fingers 46. A spigot 48 depending from the lower part 44 is a push fit in the upper annulus 18 of the flexjoint assembly 14. A frame structure 50 consisting of a multiplicity of upstanding axially spread fingers 52 (FIG. 3) united at their lower ends rests on the annulus 18, surrounds the upper part 42 and fingers 46, and is located by upstanding rim flange 54 thereof, the angular position of the frame structure 50 being such that the fingers 52 coincide with the fingers 46 of the member 40. The upper part 42 of the bell-shaped member 40 has a rod 56 connected thereto by means of bolts 58 passing through its flanged lower end 60. A piston 62 is connected by bolts 64 to the upper end of the rod 56 and slides in a cylinder assembly 66 having upper and lower outwardly directed flanges 68, 70, the lower flange 70 having upturned positions defining hooks as shown. A multiplicity of latch arms 72 depend from the cylinder assembly 66 with hooked upper ends 74 thereof located beneath the flange 68 on the upturned portions of the flange 70. The arms 72 fit between the fingers 46, 52 with inturned tips 76 thereof depending beneath the frame structure 50 and being directed parallel to an inclined seat face 77 of the lower part 44 of the member 40. The latch arms 72 are formed on the inner surfaces with cam regions 79 that cooperate with an angulation 80 (FIG. 2) on the outer surface of bell-shaped member upper part 42 to urge the arms 72 outwardly as shown in FIG. 2 as the cylinder assembly 66 and arms 72 are moved upwardly relative to the member 40. The anchor body 12 is formed with a multiplicity of sight holes 86 which give access to portions of the arms 72 to enable their angular position to be judged, e.g. by coincidence or otherwise of outwardly projecting lugs 88 with the outer surface of the body 12 to provide for visual confirmation of the presence or absence of a latching state. It will be noted that the frame 50 and arms 72 coincide with a portion of the housing 12 of enlarged internal diameter defining a cavity 90 providing for sway of the frame 50 and bell-shaped member 40 within the housing 12 within an angular travel permitted by the flexjoint 14.

The tendon 10 can be unlatched from engagement with the spigot 38 by relieving the axial load in the tendon 10 and supplying fluid under pressure to the full bore side of the piston 62, causing the cylinder assembly 66 to move upwardly from the position shown in FIG. 1 to the position shown in FIG. 2 where it is spaced above the bell-shaped member upper part 42 and where the arms 72 are lifted from their tapered seatings 78 and are forced outwards clear of the internal bore by cam region 79 and angulation 80 so that the tendon 10 and anchor body 12 may be withdrawn from the spigot 38. Latching is achieved by reversal of the above procedure and application of hydraulic pressure to the annulus side of the piston 62. Subsequent downward motion of the cylinder assembly 66 drives the arms 72 downwardly into re-engagement with the tapered seating 78 of bell member lower part 44 after which arms 72 are forced inwards to the position shown in FIG. 1. When the arms 72 are in the latching position the axial load in tendon 10 is applied, engaging the tips 76 of arms 72 with a conical underface 95 of the mushroom-headed spigot 38 via which the load is transmitted. In the normal position with tension in the spigot 10 the convex top face 97 of the spigot 38 is clear of the concave undersurface 99 of the member 40, but when tension is relieved the face 97 serves to react the weight of the tendon 10 and anchor body 12 via the surface 99. This clearance allows for heave of the tendon 10 to be taken up during the period while the latch is being established and before the tendon 10 can be tensioned.

The above marine tether anchoring device has the advantages that:

(a) the load line through flexjoint assembly 14, bell-shaped member lower part 44 and latch arms tips 76 to conical face 95 of spigot 38 is compressive;

(b) the aforesaid load line is extremely short;

(c) the load line passes from the anchor body 12 to the spigot 38 through the tips 76 of the latch arms only. The remainder of the latch arms 72 and the latching and unlatching mechanism are not subject to load during normal service;

(d) the load interfaces 78, 76, 95 between components 38, 72, 40 are conical or inclined, thus minimising the possibility of the latch sticking due to corrosion;

(e) in normal service the rod 56 is retracted into the cylinder assembly 66 and so is protected from the effects of sea water corrosion and silt deposits;

(f) the latch mechanism, consisting as it does of a series of cones nesting from below, is to a high degree fail safe and defect tolerant;

(g) the latch mechanism has a minimum of moving parts;

(h) the latch is incapable of inadvertent release. To effect release firstly the tensile load in the tether 10 must be relieved and secondly hydraulic pressure must be applied from the platform to raise the cylinder assembly 66 to the release position of FIG. 2;

(i) the split ring 24 is protected from sea water corrosion (which is promoted by the cyclically varying loads to which the anchorng device is subject) so that the flexjoint 14 and latch mechanism supported thereby may be removed for inspection;

(j) the diameter of the flexjoint 14 is not dependent on the diameter of the tendon 10;

(k) tendons of diameter above 1 meter and of relatively thin walls (about 3–6 cms.) can be anchored via a flexjoint to the sea bed;

(l) upturned fingers 52 serve to prevent tensile loading being applied to the flexjoint 14 during latching by abutment with a concave spherical face 23 in the anchor body 12 over the designed degree of sway. The spherical face 23 is provided beneath a second inturned flange 21 of the anchor body 12. There is therefore a path for reacting downward loads from the body 12 via face 23 to fingers 52 to the bell member lower part 44 and thence via bell member upper part 42 and surfaces 97, 99 to the spigot 38; and (m) the piston 62 and cylinder assembly 66 not only move the locations from which the latch arms 72 are supported but also lock in a raised or lowered position. This is of advantage during the operation of mooring the platform. Once the platform is installed, the load across the tips 76 of the latching arms 72 holds them in place.

We claim:

1. A marine tether anchoring device comprising in combination;

a tubular anchor body for eventual attachment at its upper end below a marine tether;

a spigot for eventual fixing to the sea bed so as to be upstanding therefrom and for reception in the anchor body to establish the anchor;

latching means within the anchor body for establishing a releaseable connection to the spigot; and flexjoint means supported within the tubular body for transmitting tensile load in the anchor body as an inwardly and upwardly directed compressive load through the latching means to the spigot whilst permitting relative tilting movement between the latching means and the anchor body consequent upon sway of the tether.

2. A device according to claim 1, wherein the anchor body includes bulkhead means for preventing ingress of sea water into the marine tether.

3. A device according to claim 2, wherein the spigot has a head formed with a downwardly facing conical catch face on which the latching means engages.

4. A device according to claim 3, wherein the latching means includes an axially movable support that is generally circular in plan, a plurality of latching arms depending from the support at angularly spaced intervals and having obliquely inturned downwardly facing tips of latching engagement on the catch face of the spigot at a lower position of the support, means for moving the support to an upper position, and means operable on movement of the support to the upper position to radially expand the tips of the latching arms away from latching engagement with the spigot.

5. A device according to claim 4, wherein the latching means includes a body connected to the flexjoint means to maintain its axial position relative to the anchor body as the support moves, said body having first cam means that cooperates with the tips of the latching arms as the support moves towards its lower position to urge said tips radially inwards and second means cooperating with formations on inner faces of the latching arms as the support moves towards its upper position to urge said tips radially outwards.

6. A device according to claim 5, wherein the support is movable by piston and cylinder means between the body and the support between raised and lowered positions said piston and cylinder means providing for locking of the support in either of said positions.

7. A marine tether anchoring device according to claim 1, wherein the latching means comprises an axially fixed body supported on the flexjoint means and movable members supported on the fixed body for establishing the releaseable connection to the spigot, and the anchoring device includes means for reacting a downward load from the anchor body via a load path that includes only the fixed body of said latching means.

8. A device according to claim 7, wherein the fixed body is generally bell shaped, with a head of the spigot passing into the fixed body and supporting the fixed body at a top part of its undersurface during said downward load and with a bottom rim of said fixed body supported on said flexjoint means, frame means upstanding from said rim cooperating with an inturned part spherical downwardly facing surface of the anchor body to receive downward loads from said body.

9. A device according to claim 8, wherein the upper part of the fixed body is connected to the rim of the body via spaced fingers and the frame means has upstanding fingers aligned with the fingers of the fixed body, through which upstanding fingers the downward load is received.

* * * * *